US005299957A

United States Patent [19]

Schaeffer

[11] Patent Number: 5,299,957

[45] Date of Patent: Apr. 5, 1994

[54] ELECTRICAL DEVICE

[75] Inventor: Maurice Schaeffer, Strasbourg, France

[73] Assignee: Baco Constructions Electriques-Anct. Baumgarten-SA, Strasbourg, France

[21] Appl. No.: 995,832

[22] Filed: Dec. 23, 1992

[30] Foreign Application Priority Data

Dec. 23, 1991 [FR] France ..... 91 16153

[51] Int. Cl.[5] ..... H01R 9/22

[52] U.S. Cl. ..... 439/712; 439/716

[58] Field of Search ..... 335/132; 439/709, 712, 439/713, 716, 715; 361/419, 420

[56] References Cited

U.S. PATENT DOCUMENTS 2,545,986 3/1951 Basnett .
3,679,854 7/1972 Burd .
3,748,420 7/1973 Rexroad .
4,650,272 3/1987 Doughty et al. ..... 439/712
4,713,498 12/1987 Ludwig et al. .
4,926,149 5/1990 Saens et al. ..... 335/132
4,947,290 8/1990 Ootsuka ..... 361/420 X

FOREIGN PATENT DOCUMENTS 1163937 2/1964 Fed. Rep. of Germany .
3723440 1/1989 Fed. Rep. of Germany .
2517107 5/1983 France .

*Primary Examiner*—Larry I. Schwartz
*Assistant Examiner*—Khiem Nguyen
*Attorney, Agent, or Firm*—Larson and Taylor

[57] ABSTRACT

The electrical apparatus, for example a switching device includes an enclosure (2), elements (62, 64, 66) for mounting it accordingly to at least two mounting methods, and connection blocks (8, 10) attached to the enclosure (2) and which can be moved in such a way that the screws (56) are accessible for clamping the connection wires (60) from the front or from the rear of the apparatus. The flexible hooking lugs (64, 66) which are used for the rail mounting (68) are secured by the connection blocks (8, 10) in their rear position. Moving the connection blocks (8, 10) ensures that the openings giving access to the unused clamping screws (68) are blocked out.

11 Claims, 4 Drawing Sheets

ELECTRICAL DEVICE

FIELD OF THE INVENTION

The invention concerns an electrical device comprising an enclosure, means for mounting it on a front or rear side and electrical connection contacts entering from the enclosure into at least one connection block which is mechanically connectible to the enclosure in two different positions in which clamping screws of terminals are accessible from the front or rear side, each of the terminals having the form of a frame which is movably guided in the connection block and with one end part is engageable by one of the clamping screws whereas the opposite end part of the frame by turning the axially fixed screw for clamping a wire is drawn towards a connection contact arranged in the frame in front of the clamping screw.

BACKGROUND OF THE INVENTION

Such a device is described in EP 0 219 570 B1 or U.S. Pat. No. 4,713,498. It replaces simpler versions which can only be used for one method of mounting. Two mounting methods are made possible by the fact that clamping screws of connection terminals are rendered accessible from different sides. Typical mounting methods would be fixing an electrical device on to a mounting rail by its rear surface, for example inside a control board, or mounting on the rear of a control panel by its front surface. As the same device can be used for various applications the result is lower stock-holding and transport costs.

In order to adapt it to different mounting methods the prior art electrical device has terminals whose clamping screws for the connection contacts are located in separable connection blocks which one can chose to fix in one of two opposed positions on the side walls of the electrical device enclosure, so that the same clamping screws are accessible either from the front or the back of the enclosure. In this case the electrical device and the separable connection blocks have first of all to be assembled in the necessary position corresponding to the type of mounting, before installation. This demands extra time. In addition the manufacturer cannot absolutely guarantee a correct mounting of the connection blocks. If the mounting is incorrectly carried out or if the connection blocks are accidentally forgotten serious dangers can arise since the unprotected electrical connection contacts may be energized after the device has been partially wired up and accidents can be caused by human contact.

SUMMARY OF THE INVENTION

In consequence the object of the invention is to increase safety in mounting and simultaneously save mounting time, eliminate dangers resulting from live parts and simplify stock-holdings. This objective is arrived at by the invention in that the connection block remains attached to the enclosure when shifted in front to rear directions between the different positions in which the connection contacts are close either to one or the opposite end part of the frames and that each frame cooperates with a second clamping screw which engages the frame end part opposite to the first clamping screw and is accessible from the opposite side of the connection block.

The slightly more complicated structure needed for the invention is compensated for by the advantage of the connection block being interconnected to the enclosure from the beginning. The result is that there will never arise a situation where live connection contacts are left unprotected.

In one advantageous version of the invention covering plates covering the clamping elements can be moved very easily and rapidly between closed and open positions due to the fact that the connection block is mounted to the enclosure in a lengthwise sliding manner and by using the longitudinal movement of the connection block for shifting the covering plates alternately between closed and open positions. This can be simply carried out for example by having the cover plates of the connection block sliding in guide grooves on the connection block and guiding lugs of these plates in guide grooves on the enclosure, these latter grooves being placed diagonally to the direction of movement of the connection block. The result is that the cover plates guided by the grooves on the connection block move at right angles to the direction of movement of the connection block.

In order to ensure that each of the two opposed clamping screws is held reliably in place relative to one of the terminals, another advantageous feature of the invention provides that the clamping screws are held in the connection block with a slight degree of axial play and that the threaded part is retained frictionally in a guide hole or slot in the connection block, so that when the two opposed clamping screws are completely unscrewed, the forward ends of the clamping screws are no longer engaged in the threadings but their unthreaded ends still remain in the tapped holes.

Occasionally it may be necessary to cover up the two clamping screws which operate on a terminal. To this end, in one advantageous variant of the invention it has been arranged that the closing plates be partially accessible from the exterior so that they can be moved, and that the diagonal guide grooves on the enclosure each have additionally grooves set in parallel to the direction of movement of the closing plates, thus affording the closing function without having to move the connection block.

An interesting feature is that the lengthwise movement of one or several of the connection blocks on the enclosure can be used not only to cover and uncover in turn the clamping screws but also for fixing the device simply and rapidly to a mounting rail. To this end in another advantageous variant it is proposed that the enclosure be equipped on its rear surface with hooks for fixing to the mounting rail, of which one at least is flexible but is blocked by the connection block after the latter has been moved to its extreme rear position, in which for wiring up the clamping screws are accessible from the front side.

BRIEF DESCRIPTION OF THE DRAWINGS

In the following section one example of the invention is described using drawings, of which

DETAIL DESCRIPTION OF THE PREFERRED EMBODIMENT

Figure 1:
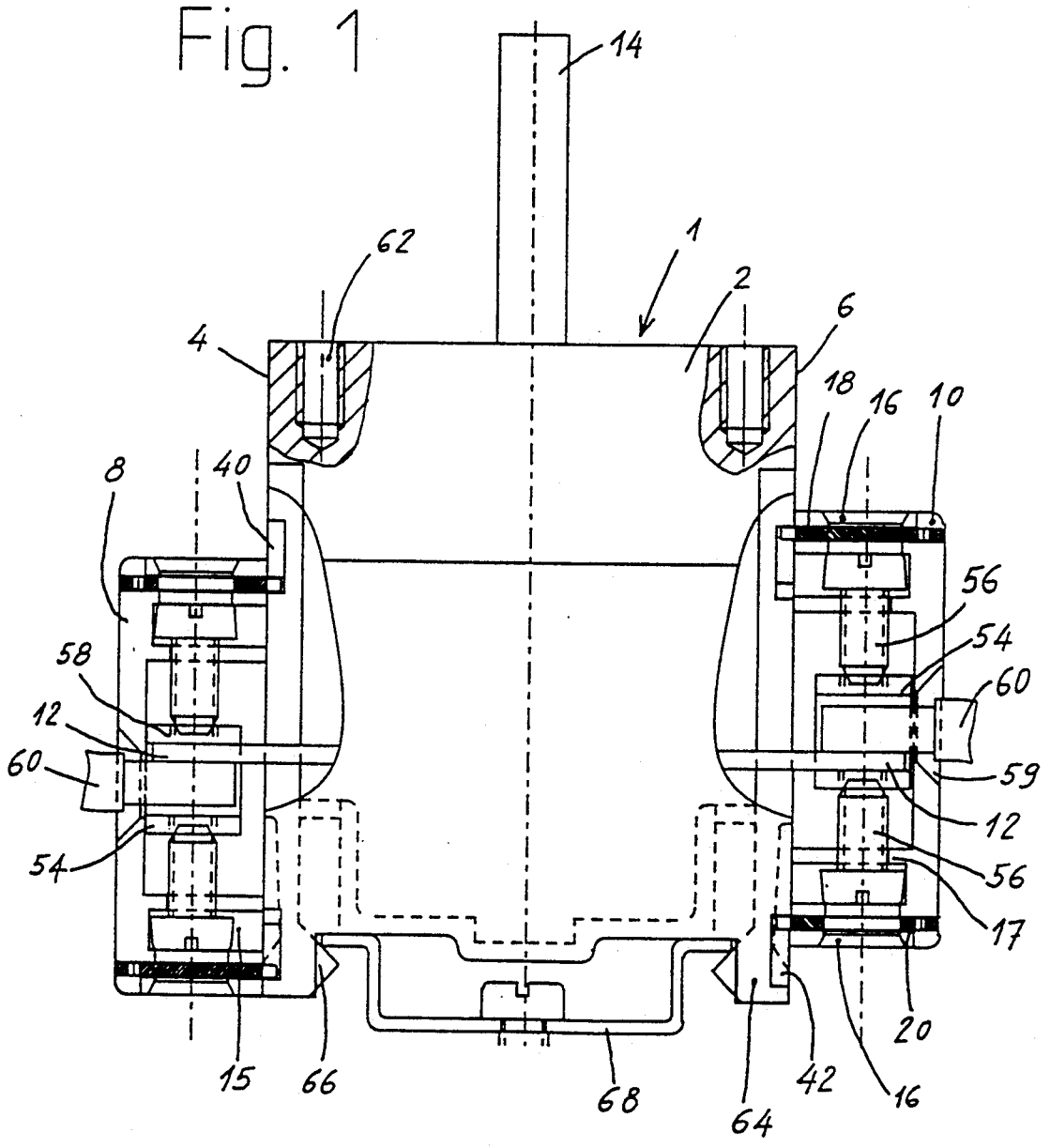
FIG. 1 is a top view of an electrical apparatus fitted with connection blocks, partly in section.
Figure 2:
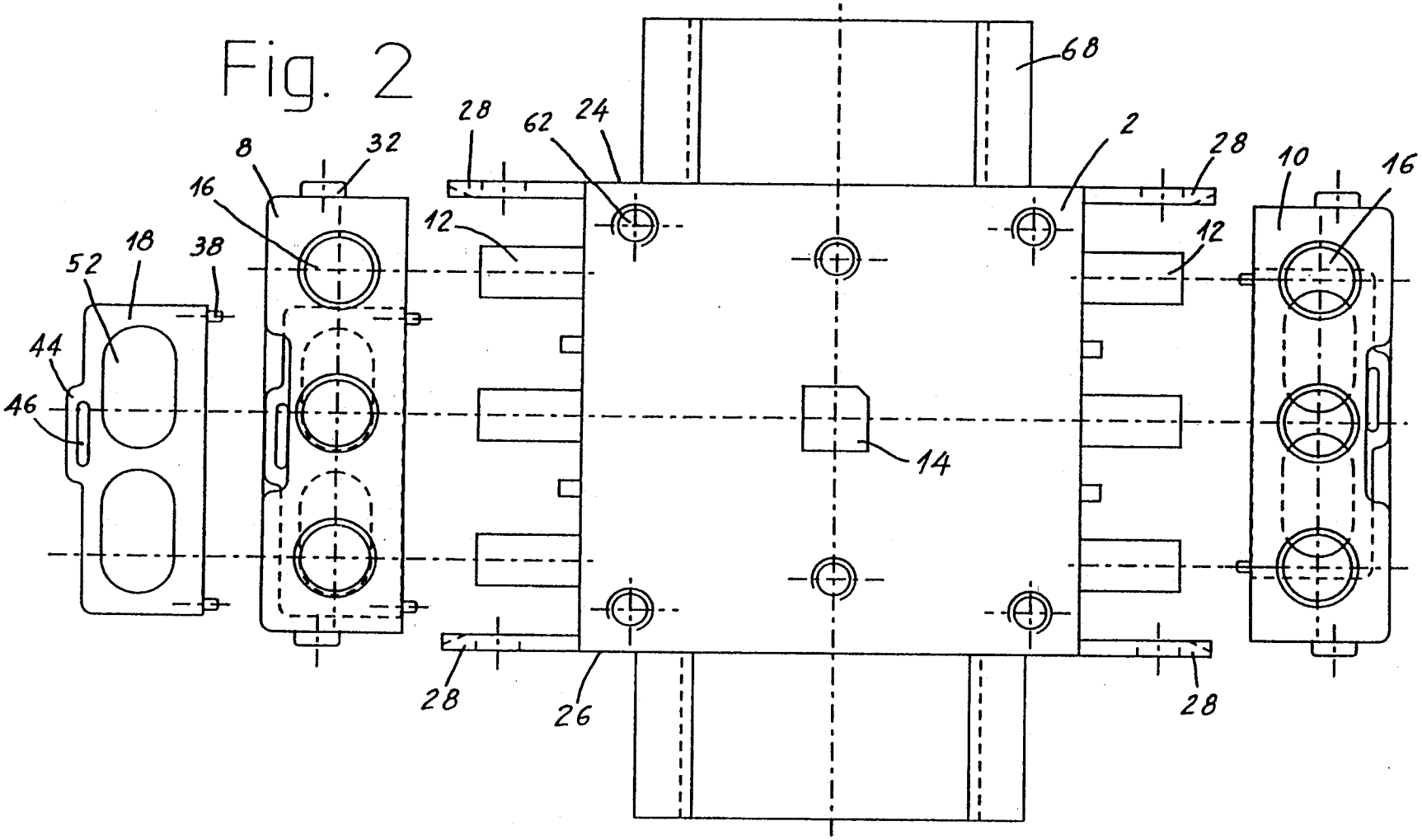
FIG. 2 is a front view of the electrical apparatus as in FIG. 1 with the connection blocks in unmounted state and with a detail drawing of a closing plate.
Figure 3:
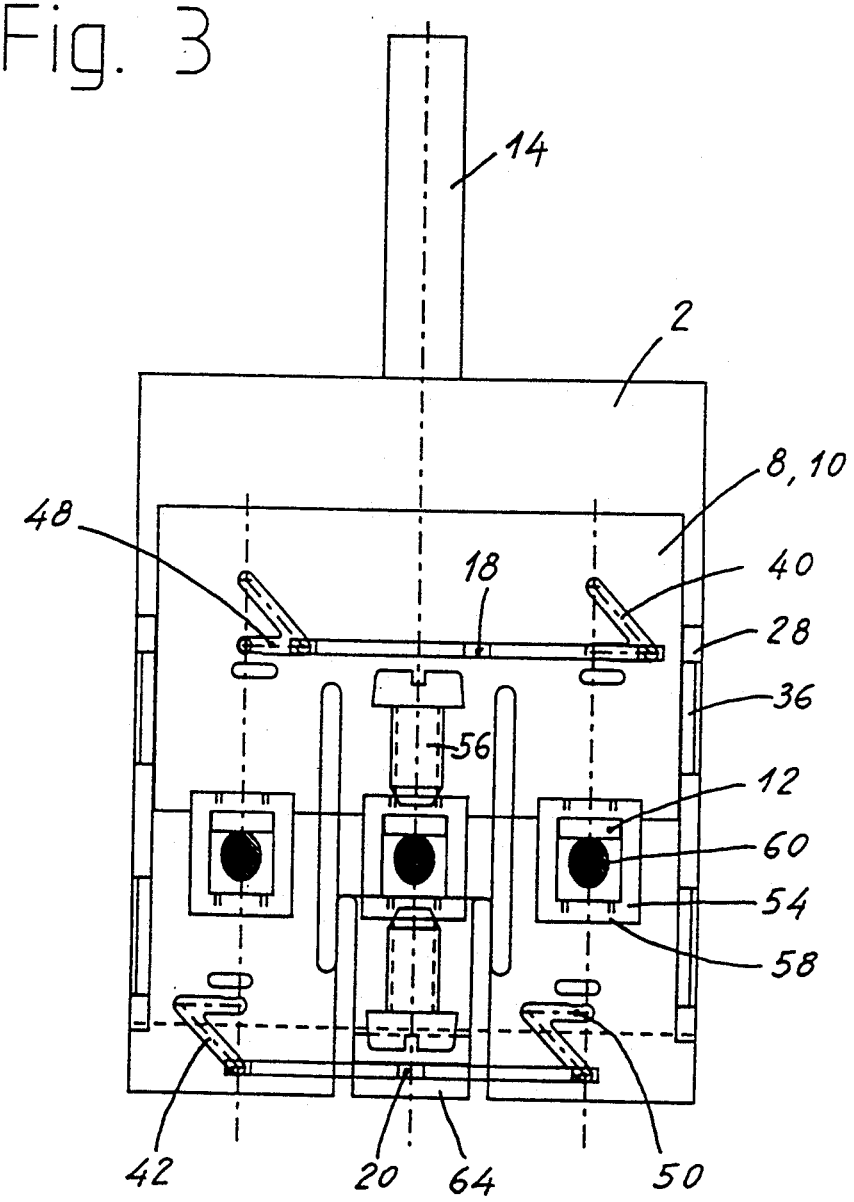
FIG. 3 is a side view of the electrical apparatus with a sectional drawing of a connection block.
Figure 5:
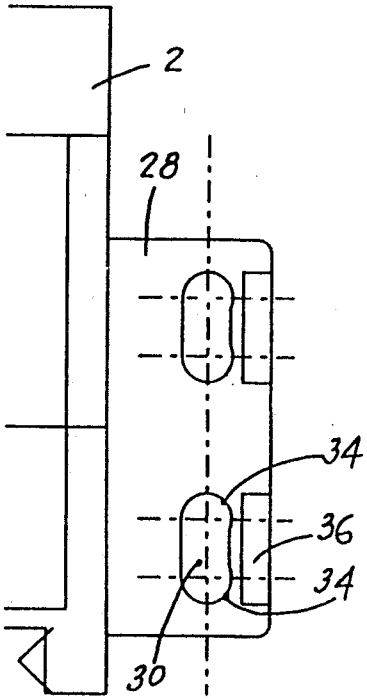
FIG. 5 is a side view of the supporting and hooking flange of a connection block.
Figure 4:
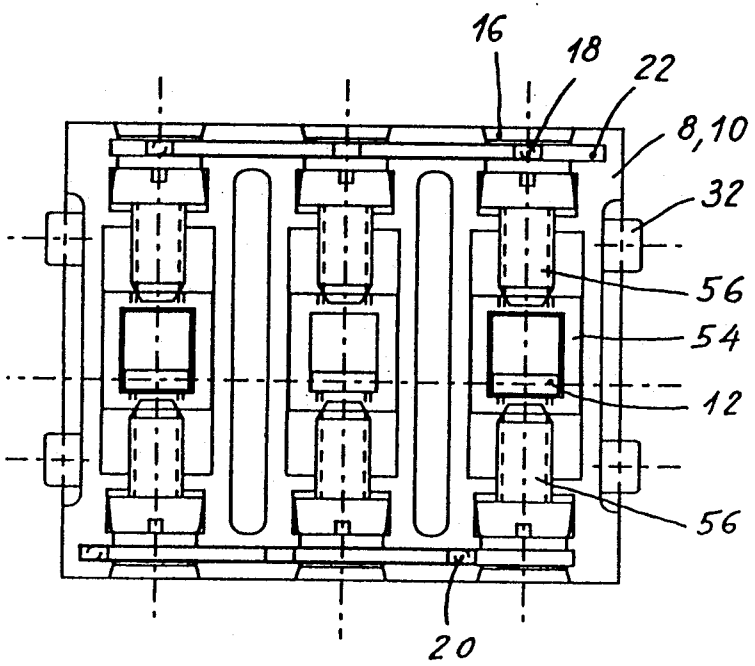
FIG. 4 is a view of the inside of the connection block.

The electrical apparatus 1 is in the form of a mainly rectangular enclosure 2 which is provided with fixing components on its front surface and also on its rear surface.

On the opposite side surfaces 4, 6 of the enclosure 2 are mounted connection blocks 8, 10 mainly flat and rectangular in shape, each of which completely encapsulate three connection contacts 12 which protrude from the enclosure 2 and which are of identical design.

On the front side of the apparatus 1 there is shown in FIG. 1 for example a swivelling drive-shaft 14. In the illustrated embodiment the electrical apparatus 1 is a multi-pole rotary switch. It is also possible, in the case of other different versions, to equip other electrical devices, at will, such as for example measuring or signalling devices, automatic circuit breakers, contacters or control devices in conformity with the invention.

The access to the clamping mechanisms of the connection contacts 12 is rendered possible on each of the two sides by a reversible system in that the connection blocks 8, 10 have on their front surface and on their rear surface circular shaped openings 16 which can be closed by covering plates 18, 20 in the front and in the rear and which are mounted so as to slide in the connection blocks 8, 10. These plates are held with a slight play in longitudinal guides 22 in the form of grooves which are each located parallel to the front and rear of the connection blocks 8, 10.

The connection blocks 8, 10 are mounted in a sliding and captive fashion on flanges 28 provided on the enclosure 2 as extensions 24, 26 to the side surfaces having no contacts, these flanges 28 having two lengthwise openings 30. Under these conditions the flanges 28 hold the connection blocks 8, 10 equipped with lugs 32 protruding sideways into the lengthwise openings 30.

At the end of the lengthwise openings 30 there are widenings 34 which broaden the lengthwise openings 30 on the side opposite to the enclosure 2, and which form notch positions for the lugs 32 of the connection blocks 8, 10 in their end positions.

The flanges 28 have narrowed-down ends in a bevel shape along the length of the lengthwise openings 30 on the opposite side of the enclosure 2, and in this way form ramps 36 which facilitate mounting.

The covering plates 18, 20 can slide thanks to a system of mechanical translation such that, when the connection blocks 8, 10 move towards one of their end positions, the covering plates are brought into either the closed position or into the open position. To this end the covering plates 18, 20, sliding under the mouth edges of the openings 16, are held by lugs 38 in front guiding grooves 40 and rear guiding grooves 42 respectively, which are positioned diagonally to the direction of the linear movement carried out by the connection blocks on one side of the enclosure 2, to take up a position according to the type of mounting required. During the linear movement of the connection blocks 8, 10 the lugs 38 slide in the diagonal grooves 40, 42 and thus move the covering plates 18, 20 at right angles to the direction of movement of the connection blocks 8, 10.

The covering plates 18, 20 have protrusions 44 which stand out partly from the connection block and which as a result are accessible from the exterior. In each of these there is a longitudinal slot 46 which in length and in width is designed to permit the entry of a standard screwdriver. The guiding grooves 40, 42 formed or cut into the enclosure 2 have, at the end where the lugs 38 of the covering plates 18, 20 are in the open position, extension guiding grooves 48, 50, extending by the length of the movement of the covering plates 18, 20 in the longitudinal guides 22 towards the closed position, which enables one to move the closing plates 18, 20 by hand, using a screwdriver, for example. Thanks to a slight constriction of the extensions 48, 50 of the guide grooves 40, 42 a notching for the lugs is obtained in the two end positions.

The covering plates are provided with two oblong openings 52 situated symmetrically. The width of these openings is greater than or equal to the diameter of the openings 16. Between the oblong openings 52 and at the ends of the covering plates 18, 20 cross-piece areas are provided which, when the covering plates 18, 20 are in the closed position, are located in the middle of the openings 16 and thus close these.

The connection contacts 12 protrude from the enclosure 2 approximately half-way up the flanges 28 and enter into terminal flames or terminals 54 which can slide inside the connection blocks 8, 10 lengthwise. Each of the frames 54 is maneuverable by means of two clamping screws 56 mounted opposite each other and acting as moving components, axially held by their heads which are located just behind the covering plates 18, 20 in appropriate axial flarings 15 of the openings 16 and which can be engaged into the tapped holes 58 of the terminals 54. By tightening up one of the terminals 54 by one of the screws 56 access to which is freed by the corresponding covering plate 18, 20 an electrical supply wire 60 inserted through a connection aperture 59 can then be secured in the terminal 54 against a connection contact 12. According to whether one or the other screw 56 is rendered accessible the wire is pressed against the front or the rear surface of the connection contact 12.

As shown the clamping screws 56, when they have been disengaged completely from the tapped holes 58 still have their non-tapped ends protruding into these holes. At the same time the rear end of the tapped screw shaft is held in a slight radial grip in a plastic guide hole or slot 17 in the connection block, with the result that using a slight axial play of the screw one can achieve a slight distance of the same size between the beginning of the thread on the screw and on the tapped hole 58. When the screw 56 is tightened up it moves by "self-tapping" in the guide hole or slot 17 by the length of the play until it is gripped by the thread in the tapped hole 58. Its front end reaches the connection contact 12 or a position close to the latter, whilst the head of the screw comes up against the outer edge of the guide hole or slot 17.

The enclosure 2 has on its front surface fixing elements in the form of tapped holes 62 which are positioned at intervals corresponding to standard mounting dimensions.

On its rear wall the enclosure 2 has, between fixed side bands housing the guides 48, 50, fixing elements in the form of elastic tongues with hooking lugs 64, 66, whose spacing corresponds to the standard of the mounting rail shown at 68. In the extreme forward position of the connection blocks 8, 10 the hooking lugs can flex outward so that the apparatus can be clipped on to the mounting rail 68. If the connection blocks 8, 10 are then moved to their extreme rear position they prevent the hooking lugs 64, 66 moving outward by blocking the outer edges of the flexible tongues, so that the clipping of the apparatus on to the mounting rails is secured and held firmly.

The device as described can have an additional feature so that when the connection blocks 8, 10 are moved their internal part comprising the terminals 54 reaches an end position slightly forward of the external part comprising the connection openings 59 and the edge of the latter covers the end of the connection contact 12 in the two extreme positions. Furthermore the side walls 24, 26 of the enclosure 2 can be fitted in a conventional way, not shown in detail on the drawing, with additional devices for mounting extra optional electrical apparatus. These apparatus could for example consist of supplementary switching equipment, and/or auxiliary contact elements for control and signalling, linked up mechanically.

These additional elements can of course be carried out in conformity with the invention.

I claim:

1. An electrical device comprising:

an enclosure having a front surface, a rear surface, and a lateral side extending between the front and rear surfaces, said enclosure being mountable on one of the front and rear surfaces;

electrical connection contacts extending from the lateral side of said enclosure;

a connection block located along the lateral side into which said contacts extend; and a mounting means for permanently mounting said connection block to the lateral side of said enclosure for an axial sliding movement therealong between a forwardmost position and a rearmost position;

said connection block including front and rear faces, respective terminal frames into which respective said contacts extend, each said terminal frame having opposed front and rear terminal sides which are alternately disposed adjacent the respective said contact while the other is spaced therefrom when said connection block is in a respective rearmost or forwardmost position, and respective sets of axially opposed clamping screws, said clamping screws of said sets being located adjacent opposite said terminal sides of respective said terminal frames, each said clamping screw being fixedly mounted axially in said connection block and having a respective end for threadably engaging an associated said terminal side and a head accessible through a respective said face of said connection block such that when one said clamping screw of an associated said terminal frame is threadably engaged in the associated said terminal side and advanced, the other said terminal side which was spaced from the associated said contact is drawn toward the associated said contact to clamp a wire therebetween.

2. An electrical device as claimed in claim 1 and further including (a) respective openings in said front and rear faces of said connection block adjacent a respective said terminal frame through which an associated said clamping screw is accessible, (b) an associated cover plate for each of said faces which are movable between an open position where said clamping screws are accessible through openings in the associated said face and a closed position where the openings are closed and the clamping screws are not accessible, and (c) a moving means for moving said cover plate alternately between the opened and closed positions as the associated said front or rear face of said connection block is positioned closer and further from the associated said front or rear side of said enclosure as said connection block moves between said forwardmost and rearmost positions.

3. An electrical device as claimed in claim 1 wherein said terminal sides include a tapped hole; wherein said clamping screws include a threaded part which is engagable in an associated said tapped hole and said ends of said clamping screws include a non-threaded end part; and wherein said connection block includes a respective guide slot for each said clamping screw in which said threaded part is frictionally held initially to provide an axial play between said threaded part and said tapped hole while retaining the non-threaded end part in the associated said tapped hole.

4. An electrical device as claimed in claim 1 wherein said enclosure includes hooking lugs on said rear side by which said enclosure is mountable to a mounting rail, one of said hooking lugs being movable to allow mounting of said enclosure; and wherein said connection block includes a blocking means for blocking the movement of said movable lug when said connection block is moved to the rearmost position and thus to hold said enclosure when mounted to the mounting rail.

5. An electrical device as claimed in claim 2 wherein said moving means for said covering plates include lugs which extend from said covering plates, mounting guide grooves in said connection block adjacent respective said faces of said connection block in which respective said covering plates are slidable in a direction perpendicular to the axial direction of movement of said connection block, and respective front and rear camming guide grooves in the lateral side of said enclosure in which respective said lugs of said cover plates are received such that movement of said connection block causes movement perpendicular thereto of said cover plates.

6. An electrical device as claimed in claim 5 wherein said camming guide grooves include portions parallel to said mounting guide grooves at the location where an associated said lug is found when the associated said cover plate is in the open position, and said cover plates include an accessible portion such that said cover plate is manually shiftable to the closed position from the open position while the other said cover plate has been moved to the closed position by said camming guide groove.

7. An electrical device as claimed in claim 6 wherein said parallel portions of said camming guide grooves have a constricted shape so that when the associated said lugs are moved into associated said parallel portions a notching of said lugs occurs in said parallel portions.

8. An electrical device as claimed in claim 2 wherein there are a series of three of said openings in said front and rear faces of said connection block; and wherein said covering plates are formed by two oblong openings and a series of three associated solid portions adjacent said oblong openings such that in the closed positions of said cover plates said solid portions are located across associated said openings in said faces and in the open positions associated said solid portions are beside associated said openings in said faces.

9. An electrical device as claimed in claim 1 wherein said mounting means includes flanges projecting from said enclosure on opposite sides of said connection block, lugs projecting from one of said flanges and said connection block, and longitudinal openings provided in the other of said flanges and said connection block in which an associated said lug is received for movement therein.

10. An electrical device as claimed in claim 9 wherein said longitudinal openings include widened notches at the ends thereof which are widened away from said enclosure.

11. An electrical device as claimed in claim 1 wherein said connection block includes an outer cover face parallel to said lateral side of said enclosure, said cover face including a respective aperture therein adjacent each of said contacts, said apertures being sized so that portions of said cover face adjacent said apertures cover the underlying said contacts in a direction perpendicular to said lateral side when said connection block is in the respective forwardmost and rearmost positions while said apertures are located to provide access in the direction to an axial area located between the associated said contact and the associated said terminal side of said terminal frame spaced therefrom in which axial area the wire is to be received.

* * * * *